United States Patent [19]

Jones

[11] 4,002,029

[45] Jan. 11, 1977

[54] PUMP MOTOR COMBINATION FOR HYDRAULIC TREATMENT

[75] Inventor: Francis L. Jones, Mentor, Ohio

[73] Assignee: Towmotor Corporation, Mentor, Ohio

[22] Filed: Sept. 22, 1975

[21] Appl. No.: 615,442

[52] U.S. Cl. ..... 60/458; 60/DIG. 10; 417/410

[51] Int. Cl.[2] ..... F15B 15/18

[58] Field of Search ..... 417/321, 349, 359, 360, 417/410; 60/473, 476, 477, 493, 903, DIG. 10, 458

[56] References Cited

UNITED STATES PATENTS

| | | | |
|---|---|---|---|
| 2,680,017 | 6/1954 | McLeod | 60/903 X |
| 3,407,598 | 10/1968 | Yokota | 60/903 X |
| 3,702,745 | 11/1972 | Segebrecht | 417/410 X |
| 3,713,749 | 1/1973 | Fitch | 417/68 X |

*Primary Examiner*—Edgar W. Geoghegan
*Attorney, Agent, or Firm*—Phillips, Moore, Weissenberger, Lempio & Strabala

[57] ABSTRACT

The invention is concerned with an improvement in a motor-pump assembly for operating a hydraulic implement, said assembly including a hydraulic pump for controlling flow of a hydraulic fluid to said hydraulic implement and an electric motor for driving said pump. The improvement comprises means for coaxially aligning a driving shaft of the motor with the driven shaft of the pump, means for directly drivingly engaging said driving shaft with said driven shaft and means for fixing said pump to said motor. The invention is particularly concerned with the case wherein said hydraulic implement comprises a hydraulic lift cylinder for adjusting the height of a fork carrying carriage of a lift truck, controlling the tilt of the lift truck mast and controlling power steering functions.

3 Claims, 2 Drawing Figures

PUMP MOTOR COMBINATION FOR HYDRAULIC TREATMENT

BACKGROUND OF THE INVENTION

Field of the Invention

The invention is concerned with an improvement in a hydraulic implement which includes a hydraulic pump for controlling flow of a hydraulic fluid to said implement and an electric motor for driving said pump. More particularly the invention is concerned with such improvement as applied to a hydraulic lift cylinder for controlling lift truck accessories such as the extension of a lift truck mast assembly, controlling the tilt thereof and controlling the power steering function of a lift truck.

Previous hydraulic implement controlling assemblies which have included a motor and pump have generally had the motor and the pump noncoaxially aligned and separated a spaced distance apart and have included a coupler of one sort or another for transmitting the rotary motion of the driving shaft of the motor to the driven shaft of the pump. Extremely careful and precise aligning has been necessary to assure that there is no misalignment of the motor and its driving shaft relative to the pump and its driven shaft. Such arrangements have generally taken up a good deal of space since space was required for the coupling. They have also presented serious alignment problems requiring the designing of special couplings. Further, they have required the use of separate bearings on a first or driving end of the driving shaft of the motor and on a first or driven end of the driven shaft of the pump.

It would be highly desirable to provide a motor and pump arrangement for a hydraulic implement which was easy to initially align and which would remain aligned through normal operation of the hydraulic implement and which at the same time would save often valuable space by providing overall a more compact arrangement of the motor and the pump portions thereof. It would be further advantageous if such an arrangement could use a single bearing to support both a first or driving end of a driving shaft of the motor and a first or driven end of the driven shaft of the pump. The present invention provides all of the above mentioned improvements in an easy to machine and inexpensive structure.

SUMMARY OF THE INVENTION

The invention is concerned with an improvement in a hydraulic implement adjusting assembly wherein the assembly comprises a hydraulic implement, a hydraulic pump for controlling flow of a hydraulic fluid to said implement and thereby controlling operation thereof and an electric motor for driving said pump. The improvement comprises means for coaxially aligning a driving shaft of the motor with a driven shaft of the pump; means for directly drivingly engaging the driving shaft with said driven shaft; and means for affixing the pump to the motor.

BRIEF DESCRIPTION OF THE DRAWINGS

The invention will be better understood by reference to the figures of the drawings and further objects of the invention will become apparent from examination of said drawings wherein like numbers denote like parts throughout and wherein.

DETAILED DESCRIPTION OF THE PREFERRED EMBODIMENT

Figure 1:
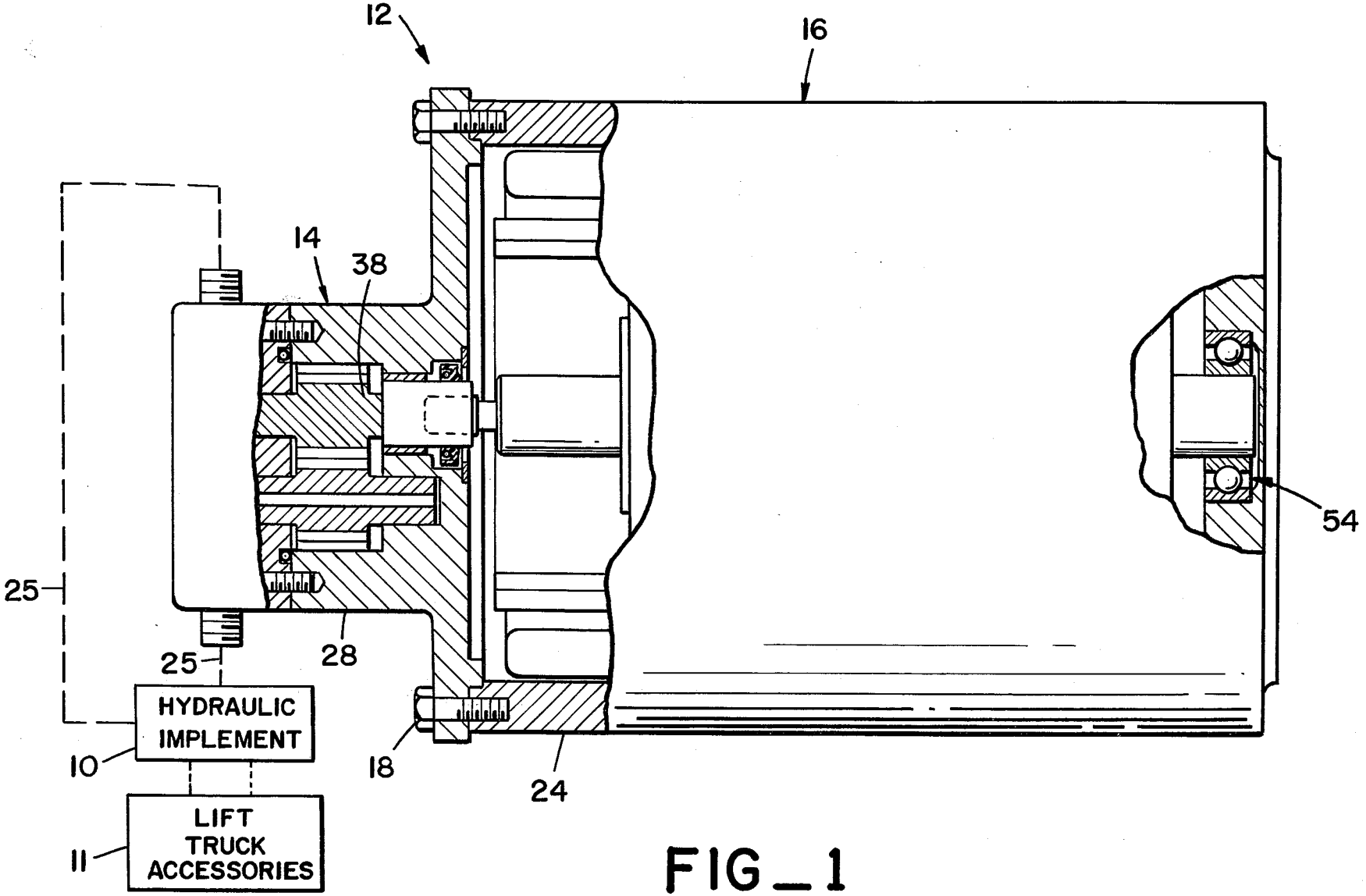
FIG. 1 illustrates the improved assembly of the present invention along with a hydraulic implement control thereby in side elevation partially cut away in partial section.

A hydraulic implement 10 for controlling lift truck accessories 11 and a control assembly 12 therefore are illustrated in FIG. 1. The improved control assembly 12 includes a hydraulic pump 14 and an electric motor 16 affixed one to the other by a plurality of bolts 18 passing through a plurality of holes 20 and into a plurality of threaded bores 22 in a casing 24 of the motor 16. Hydraulic fluid is pumped from the pump 14 to the implement 10 and returned to the pump via the lines 25. The holes 20 pass through a flange 26 which extends generally radially outwardly from a housing 28 of the hydraulic pump 14. An undercut 30 is formed generally radially within the casing 24 of the electric motor 16, said undercut 30 opening towards the hydraulic pump 14. Extending from the flange 26 is an upraised annular ridge 32 having an outer portion thereof 34 adapted to matably fit within the undercut 30 in the casing 24. The upraised annular ridge 32 and more particularly the outer portion 34 thereof serves as a pilot and still more particularly serves as a male pilot while the undercut 30 in the casing 24 also serves as a pilot, in this case a female pilot. The male pilot comprising the outer portion 34 of the annular ridge 32 and the female pilot comprising the undercut 30 matably fit together to align a driving shaft 36 of the electric motor 16 with a driven shaft 38 of the hydraulic pump 14. The previously mentioned male and female pilots serve to coaxially align the driving shaft 36 of the motor 16 with the driven shaft 38 of the pump. The bolts 18 in combination with the holes 20 and the threaded bores 22 serve as a means for affixing the hydraulic pump 14 to the electric motor 16. When the affixing means are so used they serve to force the first (female) pilot 30 against the second (male) pilot 32 in mating relationship with one another.

Means are also provided for directly drivingly engaging the driving shaft 36 with the driven shaft 38. In the embodiment illustrated the engaging means comprise a driving spline 40 adjacent a first end 42 of the driving shaft 36 and a mating driven spline 44 adjacent a first end 46 of the driven shaft 38. As will be clear from examination of FIG. 2 the driving spline 40 comprises a male spline and the driven spline 44 comprises a female spline. It is also clear from FIG. 2 that the driving spline 36 and the driven shaft 38 are coaxial about a common axis 48. It will be observed that the flange 26 in the preferred embodiment of the invention abuts an end 50 of the casing 24 and serves as an end cover for the motor 16. Tnus, a material savings results since it is not necessary to make a separate cover for the electric motor 16 and for the pump 14.

Figure 2:
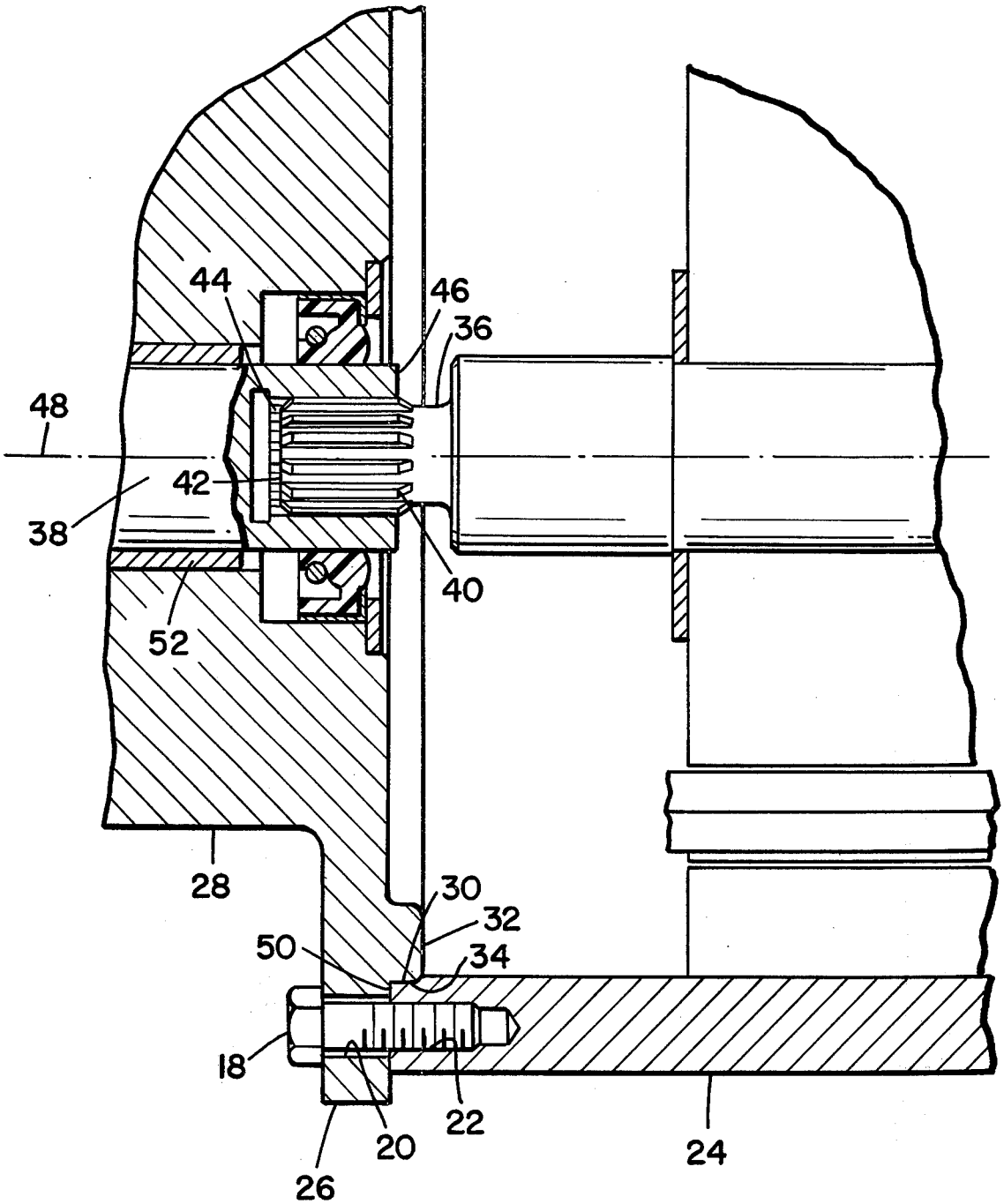
FIG. 2 illustrates in partial section a blown up view of a portion of the assembly illustrated in FIG. 1.

It will be further apparent from examination of FIG. 2 that a single bearing 52 within the hydraulic pump 14 and supported thereby serves as a bearing both for the driven shaft 38 and for the driving shaft 36 and that with respect to the driving shaft 36 the bearing 52 supports the first end 42 of the driving shaft 36, the engaging means engaging said driving shaft 36 to said driven shaft 38 which in the embodiment illustrated comprise the male spline 40 and the female spline 44. The use of a single bering 52 provides direct alignment of the driving shaft 36 and the driven shaft 38. The driving shaft 36 and the driven shaft 38 thus form an integral shaft. It is of course understood that a second end of the driving shaft 36, namely that end of the driving shaft 36 furthest within the electric motor 16 will generally be supported by another bearing 54. It may also be desirable in some cases to support a second end of the driven shaft 38, namely an end thereof furthest removed from the driving shaft 36 with an additional bearing. This is however, often unnecessary because of the integral nature of the splined together shafts 36 and 38.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as falls within the scope of the invention and the limits of the appended claims.

That which is claimed is:

1. In a hydraulic implement controlling assembly comprising a hydraulic implement, a hydraulic pump for controlling flow of hydraulic fluid to said hydraulic implement and an electric motor for driving said pump, the improvement comprising:

means for coaxially aligning a driving shaft of said motor to the driven shaft of said pump, said aligning means comprising a first pilot on said motor and a second pilot on said pump mating with said pilot, said first pilot comprising a rounded undercut in a motor surrounding cylindrical casing proceeding from said motor towards said pump and said second pilot comprising an extension from said pump towards said motor, said extension fitting matingly within said undercut, said extension comprising a generally annular ridge having a rounded edge and extending towards said motor, said ridge being upraised from a flange which extends radially outwardly from said pump to abut an end of said cylindrical casing;

means for affixing said pump to said motor with said flange abutting an end of said cylindrical casing and serving along with said pump as an end cover for said motor, said affixing means comprising a plurality of holes through said flange with axes perpendicular thereto, a plurality of threaded bores extending longitudinally into said cylindrical casing, each of said bores being alignable with a respective hole in said flange and a plurality of bolt means affixed through said holes and threaded into said bores;

means for directly drivingly engaging said driving shaft with said driven shaft, said engaging means comprising a driving spline on said first end of said driving shaft and a mating driven spline on a first end of said driven shaft; and only one single bearing supporting said driven shaft, said single bearing also serving to support the first end of said driving shaft via said engaging means.

2. An improvement as in claim 1, wherein said driving spline comprises a male spline and said driven spline comprises a female spline.

3. An improvement as in claim 1, wherein said hydraulic implement controlling assembly serves to control a lift truck accessory system.

* * * * *